United States Patent [19]

Furutsu

[11] Patent Number: 4,492,330

[45] Date of Patent: Jan. 8, 1985

[54] FASTENER ATTACHER

[75] Inventor: Akira Furutsu, Tokyo, Japan

[73] Assignee: Japan Bano'k Co., Ltd., Tokyo, Japan

[21] Appl. No.: 344,593

[22] Filed: Feb. 1, 1982

[51] Int. Cl.[3] ..... A41H 37/00

[52] U.S. Cl. ..... 227/67; 226/196; 227/156

[58] Field of Search ..... 227/67, 156, 120, 95; 226/196

[56] References Cited

U.S. PATENT DOCUMENTS 4,121,487 10/1978 Bone ..... 227/67

4,288,017 9/1981 Russell ..... 227/67

*Primary Examiner*—Donald R. Schran

*Assistant Examiner*—Douglas D. Watts

*Attorney, Agent, or Firm*—Browdy and Neimark

[57] ABSTRACT

Disclosed is an improved fastener attacher for therein loading and thereby dispensing fasteners which are manufactured in integral assemblies from a synthetic resin and which individually comprise a head, a cross-bar and their connecting filament having a connecting neck through which each fastener is connected to a common connecting rod to form a fastener assembly, which attacher comprises an attacher main body and a protective guide member which is mounted on an upper portion of the former and by which a fastener assembly loaded in the attacher is flexed and maintained along the upper edge of the attacher main body.

8 Claims, 44 Drawing Figures

FIG.3
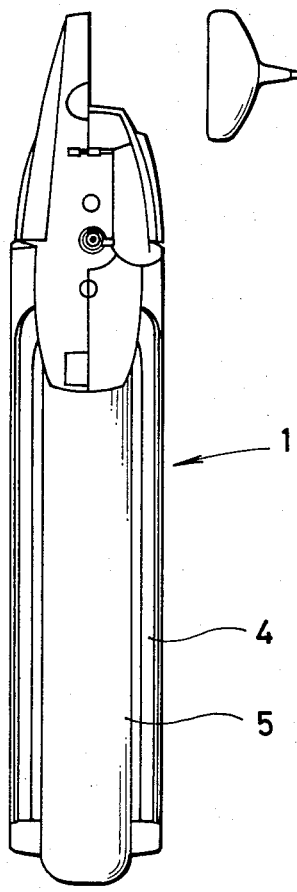
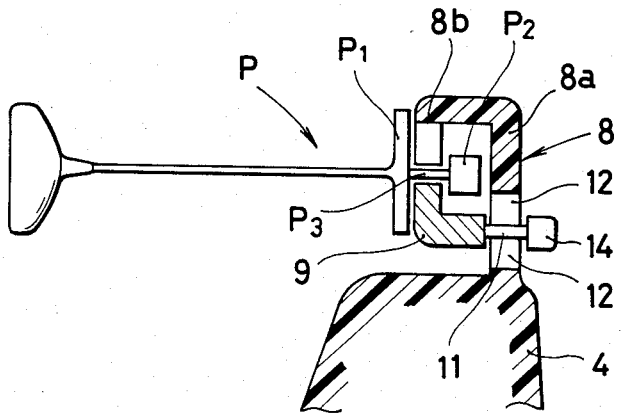
FIG.4

FIG.7
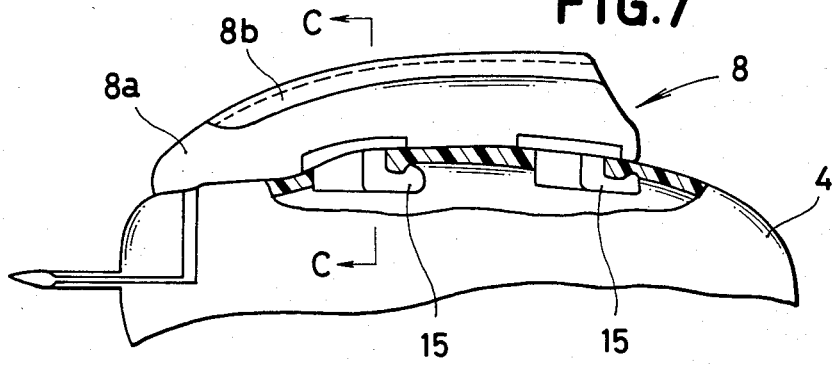
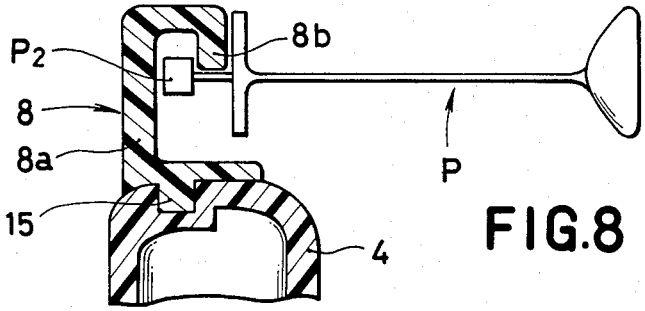
FIG.8
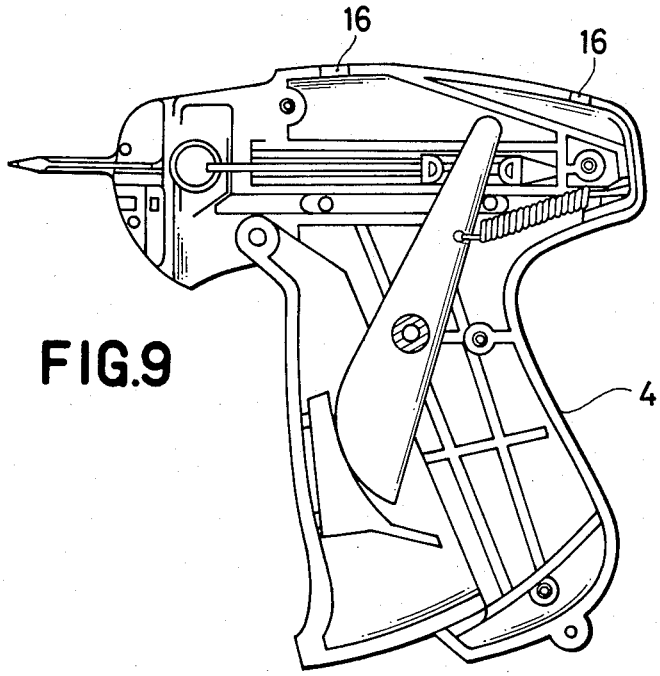
FIG.9

FIG. 24
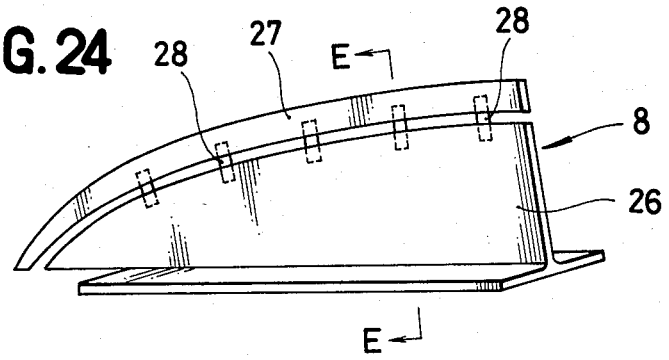
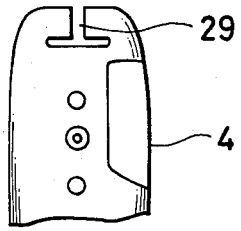
FIG. 25
FIG. 26
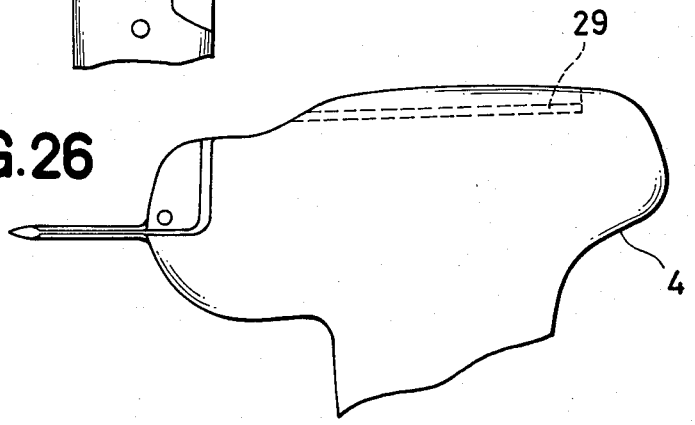
FIG. 27
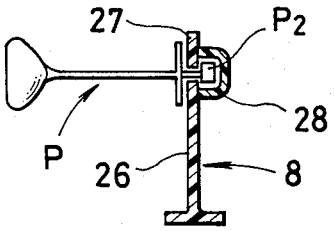

FIG.31
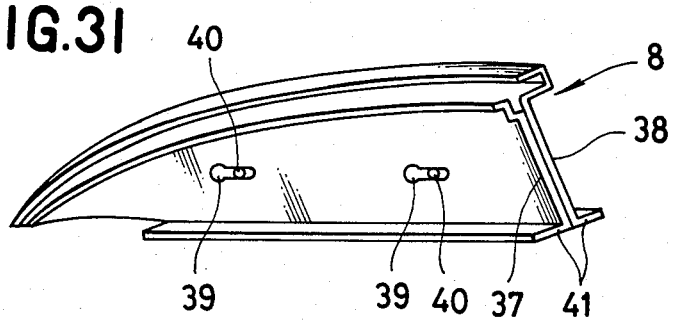
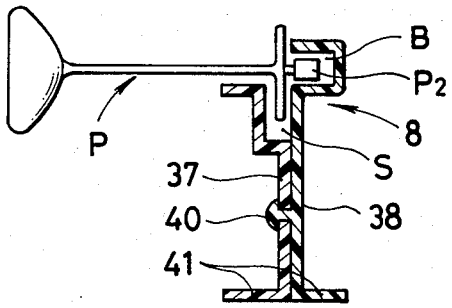
FIG.32
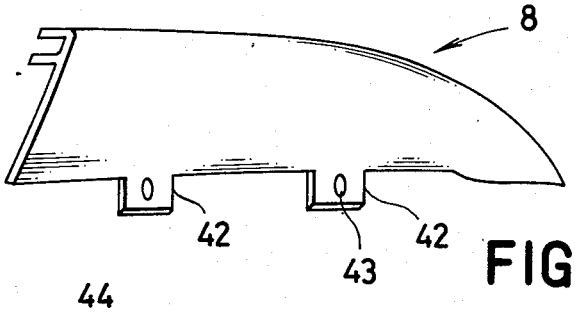
FIG.33
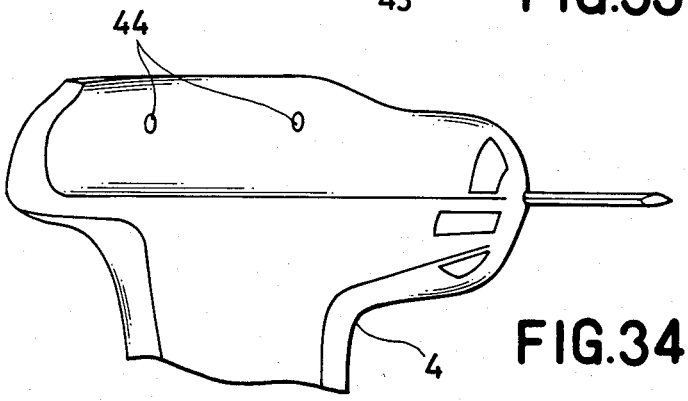
FIG.34

FIG.37
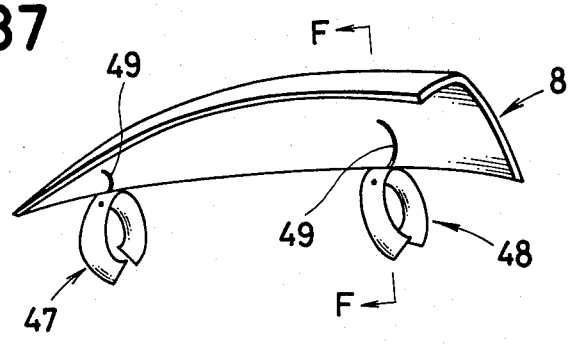
FIG.38
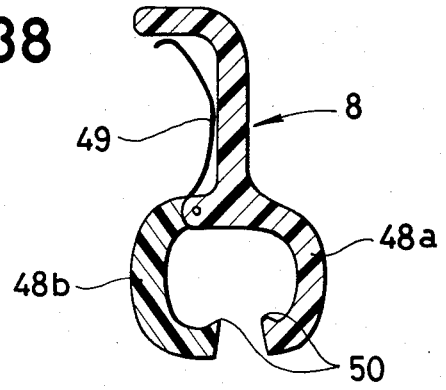
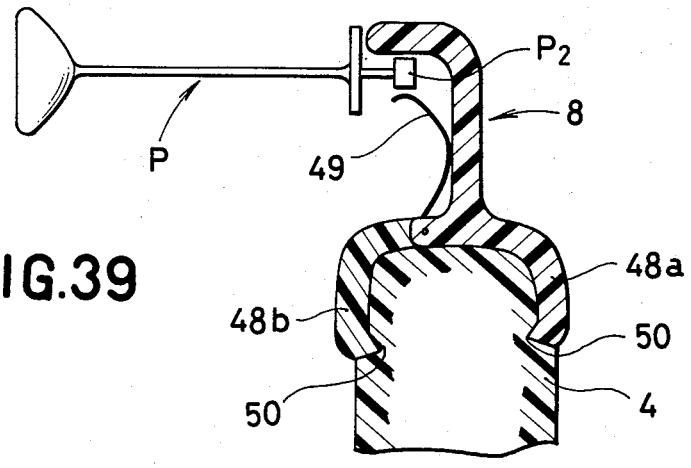
FIG.39

FIG. 42
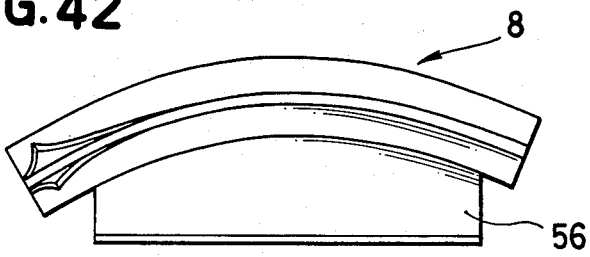
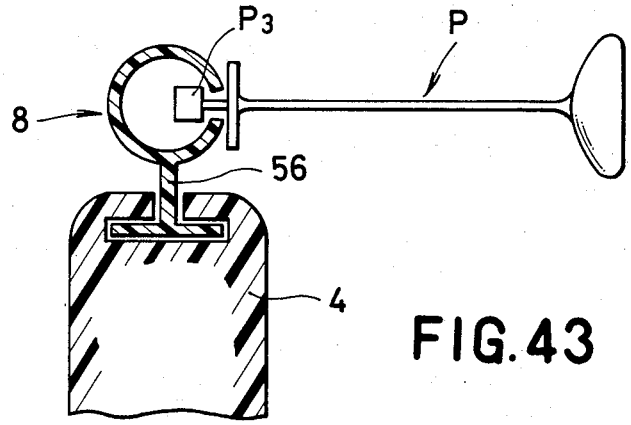
FIG. 43
FIG. 44
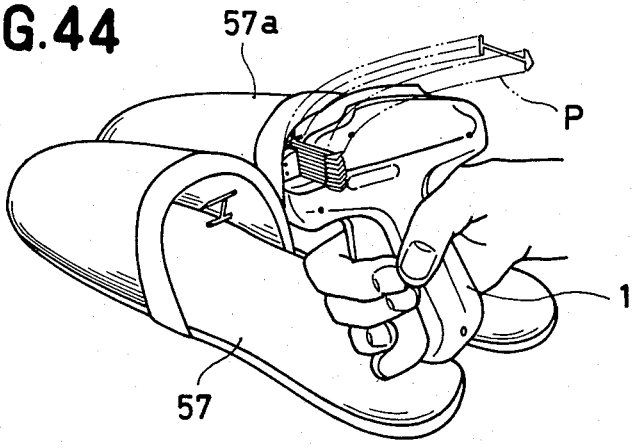

FASTENER ATTACHER

BACKGROUND OF THE INVENTION

The present invention relates to an improvement in or relating to fastener attachers, broadly. More particularly, the invention relates to an improved fastener attacher having a fastener guide means which, upon operation of the attacher, can feed individual fasteners to be dispensed by the attacher without fail and can prevent the individual fasteners from undergoing an unintended engagement with object articles or wares to which they are to be applied.

Since some time ago, an enormous number of fasteners made of a synthetic resin which are often referred to as tag pins have been utilized in, for example, attaching price tags or the like to various items of merchandise or for combining together or altogether a plurality of articles or wares to a combined unitary assembly or assemblies.

Those fasteners individually comprise a head, a crossbar and their interconnecting filament, and in normal cases, 30 to 50 individual fasteners are altogether formed on a common connecting rod to thus comprise a fastener assembly, for reasons of their production and their handling.

Fastener assemblies are molded from a synthetic resin characterized by having a property of molecular orientation such as nylon or polypropylene, and they have their filaments so stretched as to resemble a fine fiber and to be highly flexible.

In dispensing individual fasteners to object articles or wares, a fastener attacher is utilized, which has a guide groove within which a fastener assembly is loaded. As the operation lever or trigger of the attacher is then pulled, the crossbar of a first fastener is applied through an object article for example a garment, from either or the other face of the fabric thereof. Same operations as above are made also in combining to a unitary assembly a plurality of articles such as for example a pair of slippers, gloves, socks or stockings and so forth.

Then, it has of late grown to be more often demanded that a greater number of fasteners than before are to be dispensed in a continuous operation, and in accordance with this, the common connecting rod for individual fasteners in each fastener assembly is made so great in length as to be 2 to 3 times as long as the connecting rod of previous fastener assemblies and carry thereon a greater number of individual fasteners of the order of 100 to 150 or, in certain cases, 200 so that the number of fasteners to be dispensed in a continuous fastener dispensing operation can be increased.

FIG. 1 of the accompanying drawings is taken for illustration of a manner in which a fastener assembly 2 of which the common connecting rod is relatively long is dispensed by means of a conventional fastener attacher 1, in connection with a price tag 3 to be anchored by the fastener to an object article or ware.

As shown, the conventional fastener attacher 1 is devoid of means for guiding or holding in position the free end of the fastener assembly 2, whereby the fastener assembly 2 is easily permitted to sway in directions 2' and/or 2'' or, further, in this and/or that directions relative to the plane of the drawing sheet and the fastener dispensing operation is thus considerably inconvenienced. That is to say, the fastener assembly 2 is permitted to sway in various directions as a fastener dispensing operation is made, so that the operation cannot be worked at a high efficiency; in addition, an operator or user of the attacher 1 is required to always watch the swaying fastener 2 so as to effectively carry out the fastener applying operation without fail, whereby he or she has to suffer from an eye fatigue in a relatively short period of time.

Further, as the fastener assembly 2 sways as shown in FIG. 1, it often is likely that the head or crossbar or, in certain cases, the connecting rod of individual fasteners of the loaded assembly 2 becomes hooked or otherwise engaged with for example the fabric of an object garment to break the fabric yarn or otherwise damage the object article.

Furthermore, if the fastener undergoes an unintentional engagement with the object article as mentioned above, the fastener feeding mechanism of the fastener attacher can no longer be effectively operated.

SUMMARY OF THE INVENTION

It therefore is contemplated according to the present invention to give solution to above indicated various difficulties with conventional fastener attaching devices.

Thus, a first object of the present invention is to provide a fastener attacher in which a loaded fastener assembly, particularly such a one of which the connecting rod is relatively long, can be maintained in position along an upper part of the attacher.

A second object of the invention is to provide a fastener attacher which can effectively prevent swaying of a fastener assembly loaded thereon.

A third object of the invention is to provide a fastener attacher which can effectively prevent fasteners to be thereby dispensed to cause a yarn breakage or a like damage to an object article.

A fourth object of the invention is to provide a fastener attacher which is simple in structure and easy to operate in attaining the above objects.

A fifth object of the invention is to provide a protective guide member which can be applied to the main body of any type of conventional fastener attachers.

These objects of the invention are attained by a fastener attacher which is loaded with an integrally formed assembly of fasteners individually comprising a head, a crossbar and their interconnecting filament integrally molded from a synthetic resin and altogether connected through a common connecting rod, and which is provided in an upper part of the main body thereof with a protective guide member adapted to bend and maintain the connecting rod of the fastener assembly along the attacher main body.

BRIEF DESCRIPTION OF THE DRAWINGS

FIG. 3 shows a front elevational view of FIG. 2;

FIG. 4 is a sectional view taken along line A—A of FIG. 2;

FIG. 7 is a partial sectional view, showing a third embodiment of the invention;

FIG. 8 is a sectional view taken along line C—C of FIG. 7;

FIG. 9 is a sectional view of the main body of the fastener attacher according to the third embodiment;

FIG. 24 shows a perspective view of a protective guide member in a embodiment of the invention;

FIG. 25 is partial front elevation of the main body of the fastener attacher of the tenth embodiment;

FIG. 26 is a partial side elevation of the attacher main body of FIG. 25;

FIG. 27 is a sectional view taken along line E—E of FIG. 24 and shows an aspect in which a fastener assembly is held by the protective guide member of the tenth embodiment;

FIG. 31 is a perspective view of a protective guide member according to a twelfth embodiment of the invention;

FIG. 32 is a partial sectional view, showing an aspect in which a fastener assembly is held by the protective guide member the twelfth embodiment;

FIG. 33 is a perspective view, showing a protective guide member according to a thirteenth embodiment of the invention;

FIG. 34 shows a schematic side elevational view of an attacher main body according to the thirteenth embodiment;

FIG. 37 is a perspective view, showing a protective guide member according to a fifteenth embodiment of the invention;

FIG. 38 shows a sectional view taken along line F—F in FIG. 37;

FIG. 39 is a partial sectional view, showing an aspect in which the protective guide member of the fifteenth embodiment is to an attacher main body;

FIG. 42 shows a perspective view of a protective guide member according to a seventeenth embodiment of the invention;

FIG. 43 is a partial sectional view, showing the protective guide member of FIG. 42 mounted to an attacher main body and holding a fastener assembly in position; and FIG. 44 shows a view taken for illustration of a manner in which a fastener dispensing operation is worked with a fastener attacher according to the present invention.

DETAILED DESCRIPTION OF THE PREFERRED EMBODIMENTS

The present invention will now be described in greater detail in connection with the preferred embodiments thereof illustrated in FIGS. 2 and on.

Figure 2:
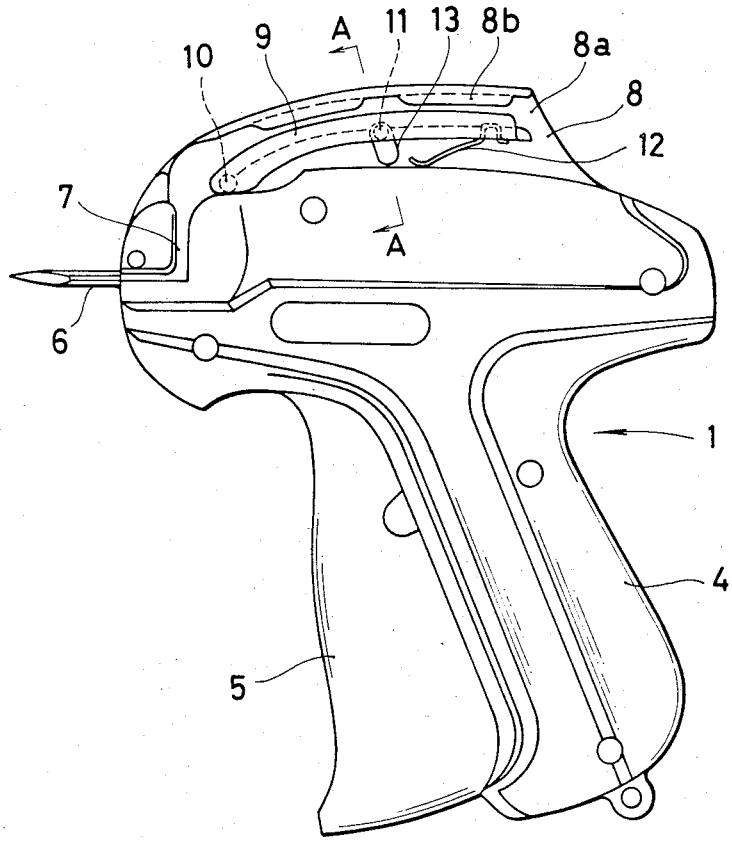
FIG. 2 is a side elevational view, showing a first embodiment of the present invention.

Initially in FIGS. 2 through 4, which represent a first one of specific embodiments of the present invention, a fastener or tag pin attacher 1 has a gun-like overall structure and broadly comprises a main body 4, a lever or trigger 5 mounted at a front side of the main body 4 in a manner capable of being pivoted in backward and forward directions relative to the main body, and a needle 6 mounted in a front nose part of the main body.

In an upper front end portion, the attacher main body 4 has a guide groove 7, in which fastener or tag pin assemblies 2 (FIG. 1) are loaded one at a time. This guide groove is formed also in conventional fastener attachers, and it is open at the top.

According to the present invention, a protective guide member 8 is incorporated along an upper edge portion of the attacher main body 4 in an integral assemblage, and between the lower edge of the guide member 8 and the upper edge of the main body 4, there is provided a support guide member 9.

As best seen from FIG. 4, the protective guide member 8 is composed of a plate-like part 8*a* and a protuberant part 8*b* protruded in a substantially L-shaped form from the top end of the plate-like portion 8*a*. The protuberant portion is formed to lie from a point slightly behind or rear of the location corresponding to the guide groove 7 so as to facilitate loading of a fastener assembly. The support guide 9 has a substantially L-shaped cross-section, and while it is pivotally supported at its front end portion to the main body 4 by a pin 10, it has in an intermediate point a pin 11 applied through a groove 13 formed in the protective guide member 8 so that its motion in vertical directions can be securely controlled. At a rear end portion, further, the support guide 9 is provided with a spring 12, and it always is biased toward the protuberant portion 8*b* of the protective guide 8.

As shown also in FIG. 4, a fastener assembly or tag pin assembly P is supported between the protuberant part 8*b* of the protective guide member 8 and the support guide 9. In this illustrated condition, the crossbar $P_1$ of each fastener of the fastener assembly P lies parallel with the surfaces of the protuberant part 8*b* and the support guide 9, and by thus supporting the crossbar $P_1$, the aforementioned swaying of the fastener assembly P is effectively checked according to the present invention.

In an open space defined within the protuberant part 8*b* and the support guide 9, a connecting rod $P_2$ which connects a number of individual fasteners to an integral assembly P is received. Further, in the gap between the facing ends of the protuberant portion 8*b* and the support guide 9, connecting necks or legs $P_3$ of individual fasteners connecting the latter to the common connecting rod $P_2$ are located.

As before stated, the support guide 9 is pivotally supported at its front end portion through the pin 10 (FIG. 2) and has at its intermediate portion the pin 11 applied through groove 13 formed in the protective guide member 8, which pin 11 has a knob 14. By pushing the knob 14 toward below, the free end or pivoting end of the support guide member 9 can be moved downward, so that, by operating the knob 14 the fastener assembly P can be supported by the protective guide member 8 and the support guide member 9 or removed out of the support by members 8 and 9.

In the first embodiment illustrated in FIGS. 2 through 4, the protective guide member 8 is integrally formed from a synthetic resin with the attacher main body 4, and a support guide member 9 separately molded from a synthetic resin is incorporated to the integral assembly of the main body 4 and the protective guide member 8. However, the present invention is not limited to such a structural detail only: For example, use may be made of a soft elastic material such as a rubber for the material for the support guide member 9, and by then securely mounting a support guide 9 relative to the protective guide member 8, it is feasible to removably mount or load a fastener assembly of a relatively great length in a same manner as described above. Alternatively, it may be devised to prepare a protective guide member 8 and the fastener attacher main body 4 separately, and insert by fitting projected portions of the protective guide member 8 in bores formed in the main body 4 to thereby provide an assembly of the main body 4 and the protective guide member 8. According to manners as described immediately above, it is possible to reduce the concept of the present invention to practice only by way of slightly modifying the existing fastener attaching devices.

As can be readily appreciated, the attacher main body 4 for the practice of the present invention can be of any type, and it may comprise for example the one disclosed in the U.S. Pat. No. 3,924,788.

Figure 5:
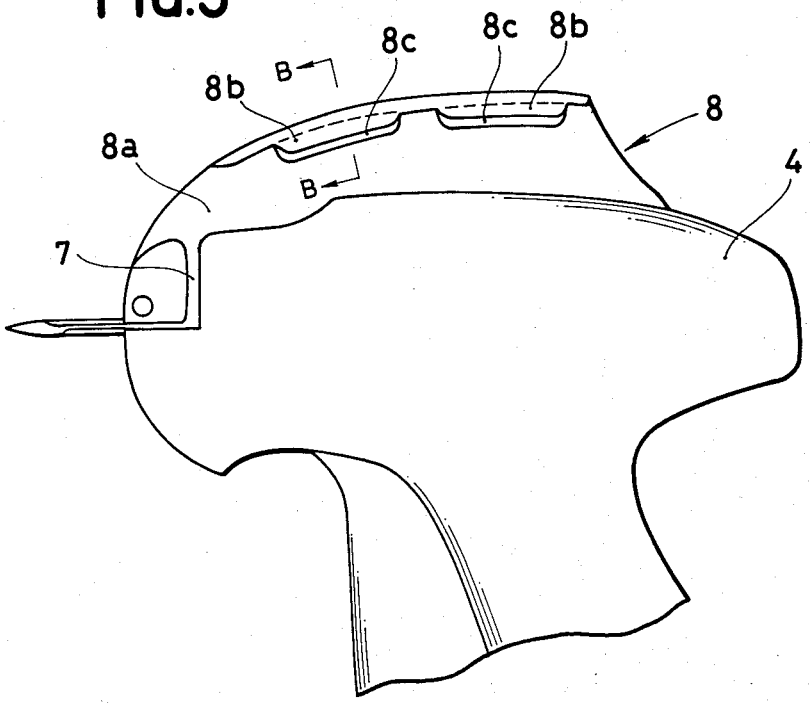
FIG. 5 is a side elevation similar to FIG. 2 and shows a second of the present invention.
Figure 6:
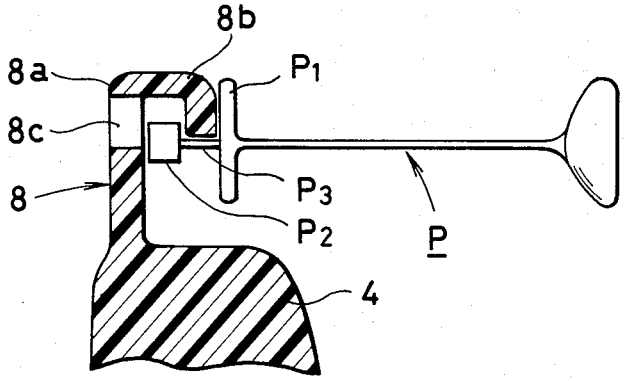
FIG. 6 shows a sectional view taken along line B—B of FIG. 5.

With the above in mind, there is shown in FIGS. 5 and 6 a second embodiment of the present invention, in which a protective guide member 8 is integrally formed with an attacher main body 4 along an upper edge part of the latter. The protective guide member 8 in this instance comprises, as best seen from FIG. 6, a plate-like part 8*a* and a protuberant part 8*b* formed in a substantially L-shaped form and connected at the top end of the part 8*a*, which has a window opening 8*c*. As in the above described first embodiment, the protuberant part 8*b* is formed from a point slightly rear of the location corresponding to the guide groove 7, and an arrangement is made such that when it is loaded in the guide groove 7, a fastener or tag pin assembly may be flexed and guided along the protective guide member 8. As shown also in FIG. 6, a fastener assembly P is supported by the protuberant part 8*b* of the protective guide member 8 in a manner of being prevented from disadvantageous swaying.

The second embodiment under consideration is devoid of a support guide member 9 as had with the first embodiment considered above, and it can provide a simplified overall structure; in addition, according to this second embodiment of the invention, incorporation of the protective guide member 8 is relatively easy and it in further addition is enabled to observe the number of unused fasteners of the loaded fastener assembly through the window opening 8*c*.

FIGS. 7 through 9 represent a third embodiment of the present invention, in which a protective guide member 8 comprises a separate member relative to an attacher main body 4, and it is formed with virtually L-shaped inserting flanges 15.

As best shown in FIG. 9, on the other hand, the main body 4 has in an upper wall portion thereof openings 16 for therein receiving the inserting flanges 15. After the inserting flanges 15 are inserted in holes 16, the protective guide member 8 may be slidably moved to secure it relative to the main body 4.

As shown in FIG. 8, an essentially L-shaped protuberant part 8*b* of the protective guide member 8 engages the fastener assembly P and allows the latter to be guided along the former in a same manner as in the first and second embodiments.

In the third embodiment under consideration, the protective guide member 8 and the main body 4 are releasably assembled so that when a fastener dispensing operation is worked in connection with such a fastener assembly as comprising a relatively small number of individual fasteners, the operation may be carried out without incorporating the protective guide member 8. Further, upon completion of the operation, the fastener attacher may be stored with the guide member 8 removed away.

Figure 10:
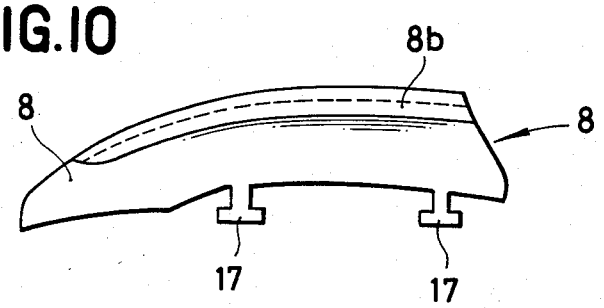
FIG. 10 shows a side elevational view of a protective guide member in a fourth embodiment of the invention.
Figure 11:
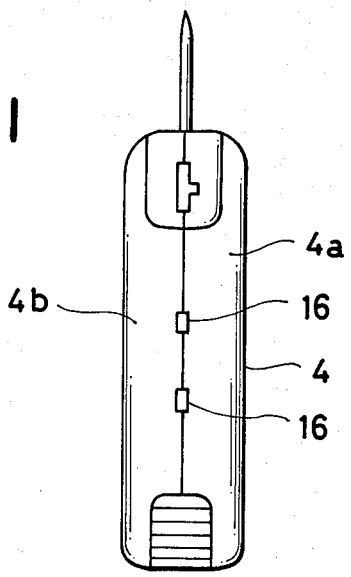
FIG. 11 is a top plan view of the main body according to the embodiment.

FIGS. 10 and 11 show a fourth embodiment of the invention, in which the protective guide member 8 has formed in lower edge portions thereof inserting flanges 17 which have a shape substantially resembling an inverse T, which are inserted in receiving holes 16 formed in upper wall portions of the main body 4, whereby the guide member 8 can be secured to the main body 4. In mounting the guide member 8 on the main body 4, the main body 4 may be divided into two segments 4*a* and 4*b* by removing the assembly bolts (not shown), and when the inserting flanges 17 are then received in holes 16, the two segments 4*a* and 4*b* may be again joined to an integral assembly by fastening the bolts, whereby the guide member 8 may be securely fixed to the main body 4.

Figure 12:
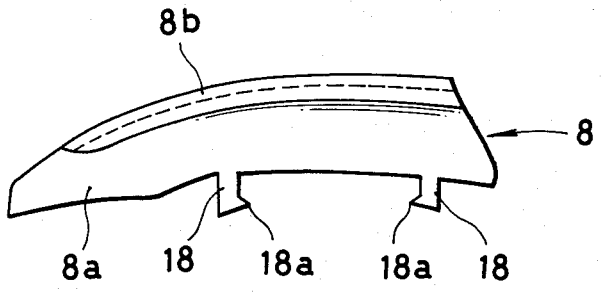
FIG. 12 is a side elevational view of a protective guide member according to a fifth embodiment of the invention.

FIG. 12 shows a further modified example of the protective guide member 8 representative of a fifth embodiment of the invention, and in this example, mounting flanges 18 formed in lower edge portions of the guide member 8 are provided with hook projections 18*a* projecting in facing directions. The hook projections 18*a* are inserted in holes 16 formed in upper wall portions of the main body as shown in FIG. 11 to have the protective guide member 8 secured to the main body 4. In this fourth embodiment again, the guide member 8 can be releasably assembled with the main body 4, and when the mounting flanges 18 are flexibly inserted in holes 16, the hook projections 18 function to prevent an unintended removal of the guide member 8 from the main body 4.

Figure 13:
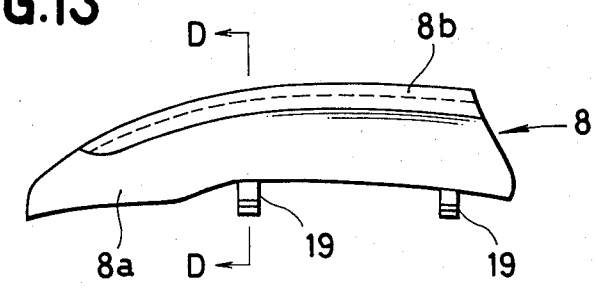
FIG. 13 is a side elevational view of a protective guide member, represting a sixth embodiment of the invention.
Figure 14:
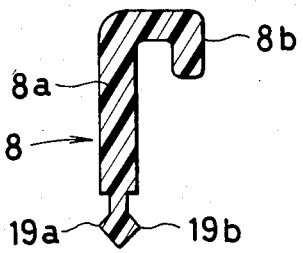
FIG. 14 is a sectional view taken along line D—D of FIG. 13.

In the sixth embodiment illustrated in FIGS. 13 and 14, mounting flanges 19 provided in lower edge portions of the protective guide member 8 are formed with bilaterally projecting ends 19*a* and 19*b*. On the other hand, the main body is formed with receiving holes 16 as shown in FIG. 11, into which the mounting flanges 19 are inserted to secure the member 8 to the main body 4. As above described in connection with the fourth embodiment, the main body 4 comprises two segments coupled together through bolts, which may not necessarily be disassembled in the instance of this sixth embodiment as opposed to the fourth embodiment, and in this sixth embodiment, the mounting flanges 19 may simply be forced into holes 16 of the main body 4 in an assembled state, when the bilaterally projecting ends 19*a* and 19*b* function to forcibly widen the holes 16 with the two segments of the main body 4 flexed. The protective guide member 8 is removably incorporated to the main body 4 again in this example.

Figure 15:
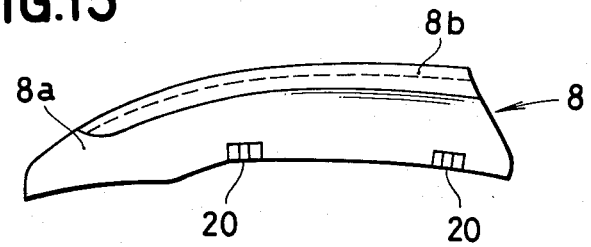
FIG. 15 is a side elevational view of a protective guide member according to a seventh embodiment of the invention.
Figure 16:
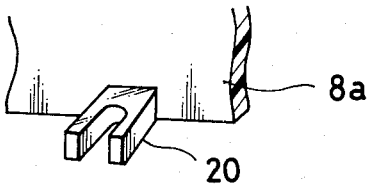
FIG. 16 is a partial perspective view, showing an essential part of the seventh embodiment.
Figure 17:
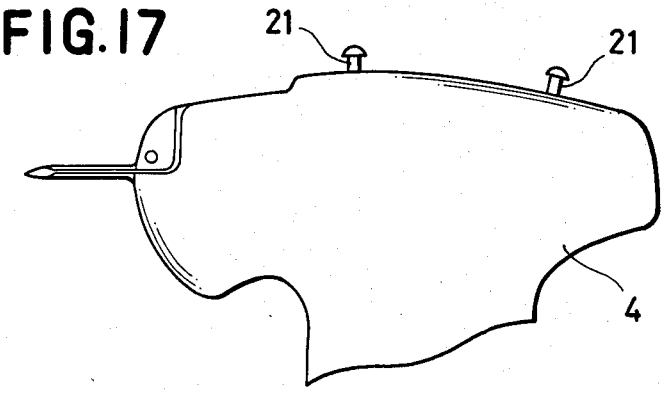
FIG. 17 shows a schematic side elevational view of the main body of the fastener attacher according to the seventh embodiment.

FIGS. 15 through 17 altogether represent a seventh one of preferred embodiments of the invention, and the protective guide member 8 in this example has in lower portions thereof inwardly projecting flanges 20, which are substantially U-shaped as shown in FIG. 16. On the other hand, the attacher main body 4 is provided with a bolt-like projections 21 as best shown in FIG. 17. Thus, by engaging the virtually U-shaped groove of the inwardly projecting flanges 20 with the bolt-like projections 21, the protective guide member 8 is removably secured to the attacher main body 4.

Figure 18:
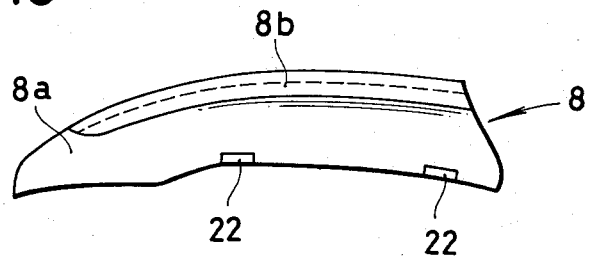
FIG. 18 is a side elevational view of a protective guide member according to an eighth embodiment of the invention.
Figure 19:
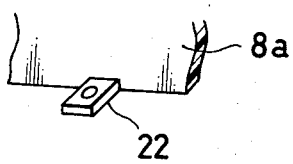
FIG. 19 is a partial perspective view, showing an essential part of the eighth embodiment.
Figure 20:
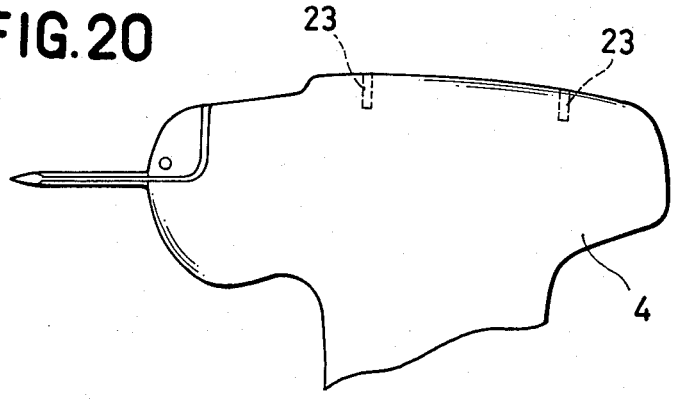
FIG. 20 shows a schematic side elevational view of the fastener attacher according to the eighth embodiment.

FIGS. 18 through 20 are for illustration of an eighth embodiment of the present invention, and the mounting flanges 22 provided in lower portions of the protective guide member 8 in this instance comprise inwardly projecting plate members having holes as shown in FIG. 19, while the main body 4 of the fastener attacher is formed in its upper wall portions with bolt holes 23 as shown in FIG. 20. The protective guide member 8 is secured to the attacher main body 4 in this engagement by way of bolts (not shown) applied through the hole of the member 8 and the bolt hole of the main body 4. In this embodiment again, the member 8 can be detachably secured to the attacher main body 4.

Figure 21:
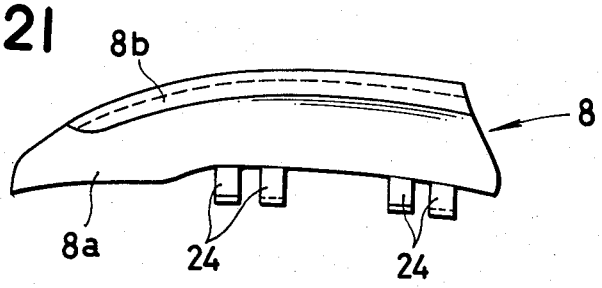
FIG. 21 is a side elevational view, showing a protective guide member according to a ninth embodiment of the invention.
Figure 22:
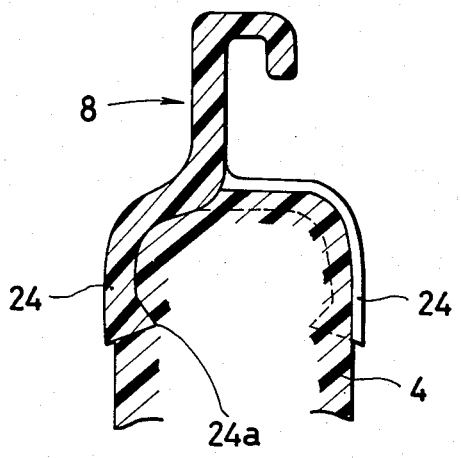
FIG. 22 shows a partial sectional view, illustrative of a manner in which the protective guide member of the ninth embodiment is mounted to an attacher main body.
Figure 23:
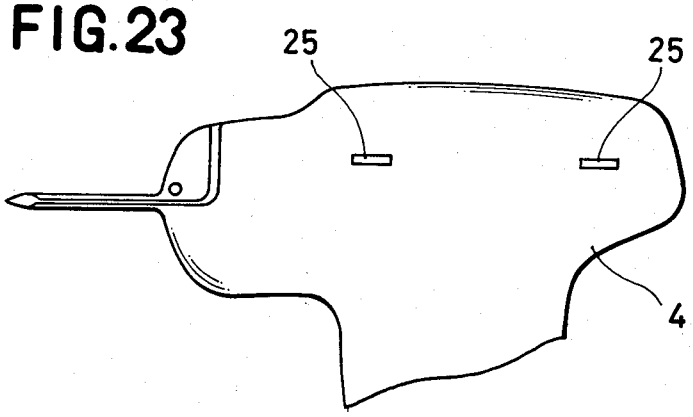
FIG. 23 is a schematic side elevation of the main body of the fastener attacher of the ninth embodiment.

FIGS. 21 through 23 altogether show a ninth preferred embodiment of the invention, in which the protective guide member 8 is provided in its lower portions with four mounting flanges 24 which comprise curved members having hook projections 24*a* which are projected alternately in facing directions as shown in FIGS. 21 and 22. On the other hand, the main body 4 is formed in an upper portion in each side thereof with two grooves 25 as shown in FIG. 23. In mounting the protective guide member 8 to the attacher main body 4, the four mounting flanges in two parallel rows are manually opened with respect to the inter-row space, and the member 8 may be disposed to straddle the main body 4 in a mahner of effectively forcing the hook projections 24*a* into grooves 25. It will be readily understood that the member 8 in this case again can be removably secured to the main body 4. It also will be apparent to those skilled in the art that whereas the curved mounting flanges 24 are provided in the number of four (4) in the illustrated example, they may be provided in any optional number, for example three (3), two in a row and the other in another row.

FIGS. 24 through 27 show a tenth embodiment of the invention, and in this example, the protective guide member 8 comprises a substantially T-shape plate member 26 and a cover member 27 spaced above the former. These members 26 and 27 are connected to each other through substantially U-shaped connector members 28 which are disposed at prescribed intervals in the longitudinal direction of members 26 and 27. On the other hand, the main body 4 is formed with a virtually T-shaped groove 29 as shown in FIGS. 25 and 26 in particular, into which the T-shape plate member 26 of the guide member 8 is inserted to removably secure the protective guide member 8 to the main body 4.

In accordance with this embodiment, there is an open space formed between the T-shape plate member 26 and the cover member 27 and inside the U-shaped connector members 28, into which the common connecting rod $P_2$ of a fastener assembly P is inserted to hold the fastener assembly P in position.

With the arrangement according to this embodiment, during a fastener dispensing operation it is feasible to inspect the number of unused or remaining individual fasteners through open spaces between the T-shape plate member 26 and the covering member 27.

Figure 28:
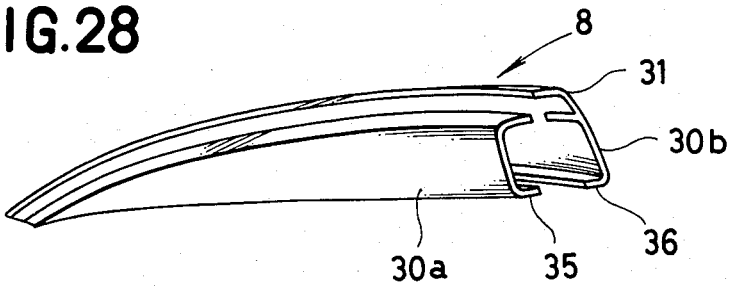
FIG. 28 shows a perspective view of a protective guide member according to an eleventh embodiment of the invention.
Figure 29:
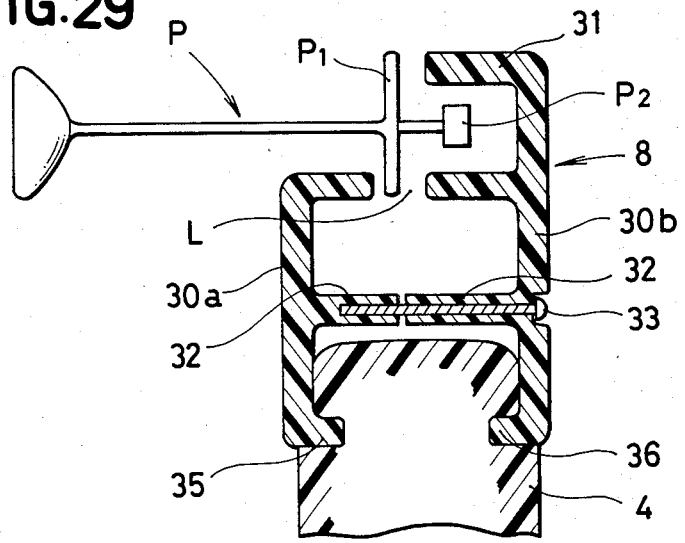
FIG. 29 is a partial sectional view, showing the protective guide member of FIG. 28, which is attached to an attacher main body and holds a fastener assembly in position.
Figure 30:
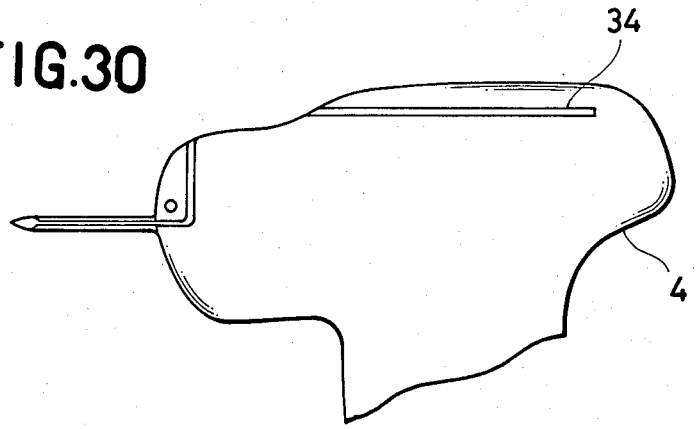
FIG. 30 shows a schematic side elevational view of the attacher main body according to the eleventh embodiment.

FIGS. 28 through 30 altogether represent an eleventh embodiment of the present invention, and as shown in FIG. 28 initially, the protective guide member 8 of this embodiment resembles a cylinder composed of spaced members 30*a* and 30*b*, of which the latter has an integrally formed cover member 30*c*. Then, as best seen in FIG. 29, the members 30*a* and 30*b* commonly have connection flanges 32 formed in the cylindrical inside thereof and are connected together through the connection flanges 32 by means of a bolt 33. On the other hand, the attacher main body 4 is formed with an elongated groove 34 along each side thereof as shown in FIG. 30. Thus, in mounting the protective guide member 8 to the attacher main body 4, the bolt 33 may be loosened to allow to open bottom plate members 35 and 36 respectively of the members 30*a* and 30*b*, and the bottom plate members 35 and 36 may be fit into the grooves 34 of the main body 4 and guided along the latter from the front end of the main body. As a result of the above operations, the protective guide member 8 can be releasably mounted to the attacher main body 4.

In guiding a fastener assembly P in the above mounted protective guide member 8, as shown in FIG. 29 the connecting rod $P_2$ may be inserted in an open space formed between the member 30*b* and the cover member 30*c*, while crossbars $P_1$ of individual fasteners of the fastener assembly P are inserted in an open space formed between upper flanges of members 30*a* and 30*b* and indicated at L.

FIGS. 31 and 32 together show a twelfth embodiment of the invention, in which the protective guide member 8 is composed of two plate members 37 and 38. While the plate 37 is provided with slots 39 having larger and smaller diametral portions, the other plate 38 is formed with projections 40, which may be inserted in the larger diametral portions of slots 39 and slided towards the smaller diametral portions, whereby the plates 38 and 39 are integrally assembled to the protective guide member 8. Then, the lower flanges 41 formed at the bottom of plate members 37 and 38 may be inserted in a T-shaped groove formed along an upper edge part of the attacher main body as shown in the before considered FIG. 25, whereby the protective guide member 8 can be releasably mounted to the fastener attacher main body 4.

Then, in guiding a fastener assembly P in the protective guide member 8 of this embodiment, as shown in FIG. 32 the connecting rod $P_2$ of the fastener assembly may be inserted in an L-shaped opening B formed in an upper part of the plate member 38, while crossbars $P_1$ are inserted in a gap S formed between the two plate members 37 and 38.

As before mentioned, in this embodiment of the invention, too, the protective guide member is releasably mounted to a fastener attacher or its main body.

FIGS. 33 and 34 together represent a thirteenth embodiment of the invention, and the protective guide member 8 in this example is formed with downwardly projecting mounting flanges 42, which have vertical slots 43.

On the other hand, the attacher main body 4 is provided, as shown in FIG. 34, with engaging projections 44 which have laterally elongate heads and which are rotatably attached to side walls of the main body 4. In mounting the guide member 8 to the main body 4, the heads of engaging projections 44 of the latter may be inserted in their vertically long positions through the slots 43 of the former and may then be rotated to their laterally long positions.

The protective guide member 8 is removably mounted to the attacher main body 4 again in accordance with this embodiment.

Figure 35:
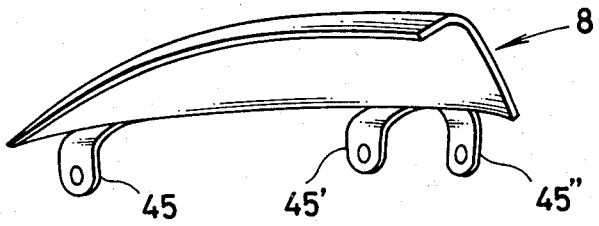
FIG. 35 is a perspective view, showing a protective guide member according to a fourteenth embodiment of the invention.
Figure 36:
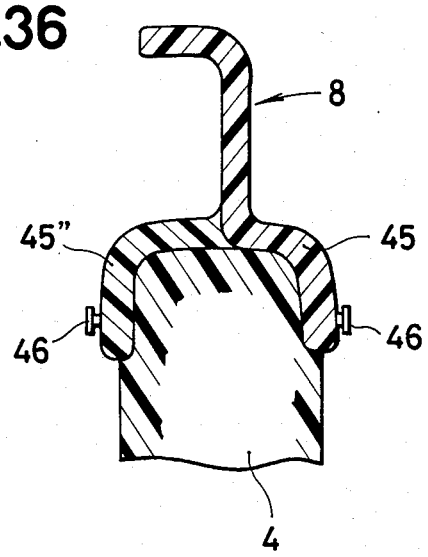
FIG. 36 is a partial sectional view, showing an aspect in which the protective guide member is mounted to an attacher main body in the fourteenth embodiment.

FIGS. 35 and 36 together represent a fourteenth embodiment of the invention, and the protective guide member 8 in this example is provided with curved mounting legs, which are provided in the number of 3 and indicated at 45, 45' and 45'' and each of which is formed at its tip end with a bolt hole 46, as shown in FIG. 35.

Then, as shown in FIG. 36, the guide member 8 is mounted in a straddling manner to the attacher main body 4 and is secured to the latter by bolts 46.

Whereas 3 mounting legs are provided in the illustrated embodiment, the present embodiment of the invention is not under any limitation in this respect and the legs may be provided in a number of 4 or more. Also, it will be readily understood that the protective guide member can with ease be dismounted by loosening the bolts 46.

FIGS. 37 through 39 are altogether to illustrate a fifteenth embodiment of the invention. As shown in FIG. 37 initially, the protective guide member 8 in the present embodiment has two pairs 47 and 48 of nip members, which are provided at their respective base portions with a spring 49 and which are normally in a condition as shown in FIG. 38 in which the nip members **48*a* and 48*b* are maintained close to each other by the function of the spring 49**.

Then, in attaching or mounting the protective guide member 8 to the attacher main body 4 as shown in FIG. 39, the nip member 47 and 48 are opened against the spring forth of springs 49 and their lower end claws 50 are inserted in side grooves of the attacher main body 4, whereby the guide member 8 can be removably secured to the main body 4 with the nip members fastening the main body as a result of the functioning of springs 49.

In this embodiment, an upper end portion of each spring 49 functions to press the connecting rod $P_2$ of a loaded fastener assembly P against the guide member 8 and maintain the fastener assembly in position.

Figure 40:
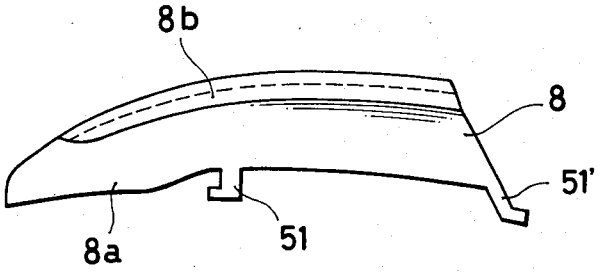
FIG. 40 shows a side elevational view of a protective guide member according to a sixteenth embodiment of the invention.
Figure 41:
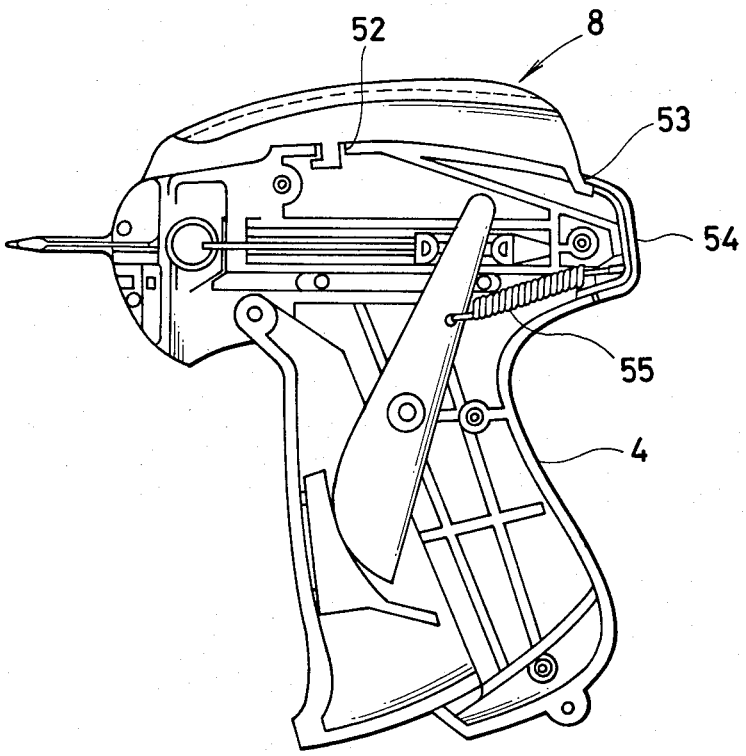
FIG. 41 is a sectional view, showing a fastener attacher having the protective guide member mounted thereto according to the sixteenth embodiment.

FIGS. 40 and 41 illustrate a sixteenth embodiment, and the protective guide member 8 in this example is provided with a downwardly projected mounting flange 51 and a rear end mounting flange 51' which is projected rearwardly and downwardly, as shown in FIG. 40. This protective guide member 8 is mounted to an attacher main body 4 as shown in FIG. 41. In greater detail, the mounting flange 51 is inserted in a hole 52 provided at an intermediate point of an upper wall of the main body, while the rear end mounting flange 51' being inserted in a hole 53 provided at a rear end point on the upper wall of the main body 4.

In the embodiment of the invention under consideration, the hole 53 is extended toward inside a box cover 54 of the attacher main body 4, and the box cover 54 is adapted to be closably opened through a spring 55 mounted within the main body 4. That is to say, by opening the box cover 54, the rear end mounting flange 51' may be inserted in the hole 53, and then the box cover may be closed, whereby the flange 52 is pressed by the box cover to thereby have the guide member 8 securely mounted to the main body 4.

FIG. 42 shows a protective guide member according to a seventeenth embodiment of the invention, in which the protective guide member 8 comprises a cylinder having a slit along a side wall thereof and an inverse T-shaped mounting plate 56 in a lower portion thereof. On the other hand, the attacher main body 4 is formed with a groove corresponding to the shape of the mounting plate 56, and as shown in FIG. 43, the mounting plate 56 is inserted in the groove of the main body 4 to thereby have the protective guide member 8 removably secured to the main body 4. This seventeenth embodiment is not limited to the example shown in FIG. 42 only, but it may with ease be devised to replace the mounting plate 56 by any of the various mounting members described in connection with the foregoing embodiments of the invention.

Now, reverting to FIGS. 2 through 4, a description will be entered in connection with the fastener dispensing operation with use of the fastener attacher according to the present invention.

Firstly, a fastener or tag pin assembly P may be inserted with its lower end portion into the guide groove 7 of the fastener attacher 1, and with the support guide 9 pushed down by pushing down the knob 14 of the protective guide member 8 to widen the opening between the protuberant part **8*b* of the protective guide member 8 and the support guide member 9**, the remaining part of the fastener assembly may be loaded with the connecting rod $P_2$ in a flexed condition.

As the knob 14 is then released from pushing, the support guide member 9 is permitted to rise by a spring force to obtain a condition as shown in FIG. 4 in which a fastener assembly P has been completely loaded in the attacher 1. As it is loaded in the fastener attacher 1, the fastener assembly P is in a flexed or bent condition.

FIG. 44 shows a manner in which the fastener dispensing operation is made with use of the fastener attacher according to the present invention, and in case for example a fastener is dispensed in connecting together a pair of slippers 57 by means of a fastener attacher according to the present invention, the fastener assembly P is maintained in a condition of being flexed along the upper edge of the attacher 1 and the connecting rod and the crossbar are maintained in position in the protective guide member 8, so that it is without fail realized that individual fasteners are prevented from being hooked or otherwise engaged with a front portion 57*a* of the slippers.

A same as above applies also in cases where for example a price tag is anchored to a sleeve of a jacket or the like, and fasteners can be thus prevented from contacting an object article for example a garment, so that a yarn breakage or a like damage to the object article can be effectively prevented.

As stated above, with the fastener attaching device according to the present invention, it is provided with a protective guide member 8, by or in which the connecting rod $P_2$, connecting necks or legs $P_3$ and crossbars $P_1$ are guided and supported in a manner of being flexed along the upper edge of the attacher main body 4, so that not only a swaying of the fastener assembly P causative of a damage to an object article is effectively prevented from occurring but also individual fasteners of the loaded fastener assembly can be smoothly fed for dispensing operations.

According to the present invention, further, a fastener assembly of a relatively great length having a relatively great number of individual fasteners can be dispensed without difficulty, so that a continuous fastener dispensing operation can be carried out in connection with an extremely long fastener assembly.

Figure 1:
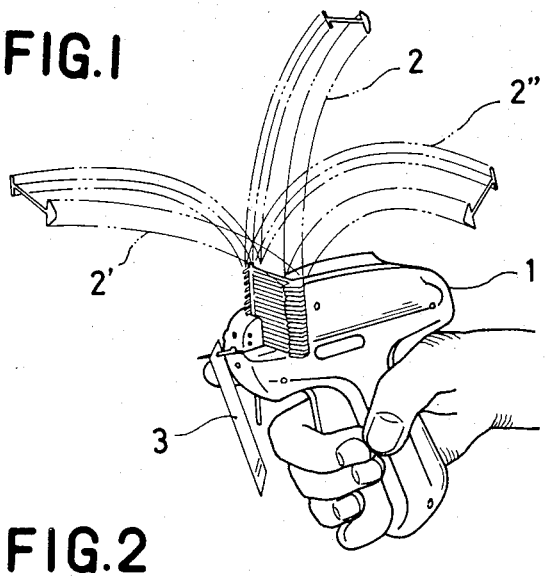
FIG. 1 shows a view illustrative of a manner in which a fastener dispensing operation is made with a conventional fastener attacher.

Further, whereas when long fastener assemblies are put for fastener dispensing operations with use of conventional attaching devices, the fastener assembly is easily prone to sway as illustrated in FIG. 1 to cause that the head and the filament of individual fasteners become entangled, according to the present invention, swaying of the fastener assembly is nearly completely avoided, so that an intertwining of fasteners can be checked.

Furthermore, the protective guide member 8 provided to the attacher main body in accordance with the present invention is extremely simple in structure and can with ease be incorporated in conventional attacher main bodies of various types. Moreover, the protective guide member 8 can be assembled either integrally or removably with an attacher main body, and for example for purposes of transportation or storage, the protective guide member 8 may be dismounted from an attacher main body to realize a space economization.

What is claimed is:

1. A fastener attaching device for loading and dispensing an assembly of fasteners, each fastener having a head, a crossbar, a filament connecting together the head and the crossbar, a neck disposed normal to the crossbar and extending away from the head, connecting rods disposed at the end of the fastener neck opposite the crossbar and extending normal to the neck and crossbar, the connecting rods of the fasteners being integrally joined and interconnecting the fasteners to form the assembly, said attaching device comprising:

means for individually dispensing said fasteners including an attachment mechanism, and means, disposed along an upper surface of said dispensing means, for holding said fastener assembly, said holding means includng a first wall extending upwardly from, and substantially normal to, said dispensing means upper surface, and a second wall extending normal to said first wall and overlaying said upper surface, said first and second walls defining means for guiding said fastener assembly connecting rods to said attaching mechanism, said second wall including surface means, disposed parallel to said first wall, for supporting said crossbars of said fastener assembly, said surface means comprising a third wall extending toward said upper surface parallel with said first wall, said third wall including a surface facing said upper surface and abutting the necks of said fasteners, said third wall being positioned between said crossbars and said connecting necks of said fastener assembly.

2. The fastener attaching device of claim 5, wherein siad first, second and third walls define means for housing said connecting rods of said fastener assembly.

3. The fastener attaching device of claim 1, wherein said first wall includes an opening for observing the number of unused fasteners in said guide means.

4. A fastener attaching device for loading and dispensing an assembly of fasteners, each fastener having a head, a crossbar, a filament connecting together the head and the crossbar a neck disposed normal to the crossbar and extending away from the head, connecting rods disposed at the end of the fastener neck opposite the crossbar and extending normal to the neck and crossbar, the connecting rods of the fasteners being integrally joined and interconnecting the fasteners to form the assembly, said attaching device comprising:

means for individually dispensing said fasteners including an attachment mechanism; and means, disposed along an upper surface of said dispensing means, for holding said fastener assembly, said holding means including a first wall extending upwardly from, and substantially normal to, said dispensing means upper surface, and a second wall extending normal to said first wall and overlying said upper surface, said first and second walls defining means for guiding said fastener assembly connecting rods to said attaching mechanism, said second wall including surface means, disposed parallel to said first wall, for supporting said crossbars of said fastener assembly, said holding means further including a dispensing end located near said attaching mechanism and a loading end disposed rearwardly thereof, said dispensing end including pivot means pivotably supporting means for retaining said fastener assembly in said guide means.

5. The fastener attaching device of claim 4, wherein said retaining means includes a portion for supporting the connecting necks of said fasteners of said fastener assembly.

6. The fastener attaching device of claim 5, wherein said portion is directed toward said second wall.

7. The fastener attaching device of claim 4, wherein said retaining means is normally urged toward said second wall.

8. The fastener attaching device of claim 7, wherein said first wall includes an opening therethrough defining a slot, and said retaining means comprises a handle projecting through said opening, said retaining means being manipulable, via said handle, into and out of first and second positions relative to said fastener assembly connecting rods, said first position locking said fastener assembly within said guiding means and second assembly unlocking said fastener assembly from said guiding means.

* * * * *